United States Patent [19]

Dowaliby

[11] Patent Number: 5,041,297

[45] Date of Patent: Aug. 20, 1991

[54] APPARATUS AND METHOD FOR CANNING FOOD PRODUCTS

[75] Inventor: Todd H. Dowaliby, Hammond, Oreg.

[73] Assignee: Carruthers Equipment Co., Warrenton, Oreg.

[21] Appl. No.: 534,764

[22] Filed: Jun. 7, 1990

[51] Int. Cl.[5] ..... A23B 4/00; B65B 55/00

[52] U.S. Cl. ..... 426/397; 53/438; 53/529; 141/71; 141/146; 425/192 R

[58] Field of Search ..... 426/397; 53/258, 438, 53/439, 473, 517, 529; 141/71, 146, 150; 425/190, 192 R

[56] References Cited

U.S. PATENT DOCUMENTS

| | | | |
|---|---|---|---|
| 3,476,037 | 11/1969 | Gorby | 53/529 |
| 3,552,454 | 1/1971 | Deming | 141/146 |
| 4,330,252 | 5/1982 | Bullock et al. | 53/529 |

*Primary Examiner*—George Yeung
*Attorney, Agent, or Firm*—Robert L. Harrington

[57] ABSTRACT

An apparatus for canning food products wherein segmented food product contained in a basin of the apparatus is compressed by a plunger down through a cylindrical bore and into a shuttle pocket. The shuttle pocket contains a pre-determined quantity and mass of the food product which is then transferred to a container. The apparatus can be converted to fill different container sizes with different quantities of the food product due to the provision of interchangeable inserts for passages, e.g. for the cylindrical bore. The shuttle product itself is interchangeable as are the plunger heads. The design for interchangeability of these components is adapted for rapid changeover to different container sizes utilizing quick connect fasteners for the interchangeable components.

11 Claims, 5 Drawing Sheets

APPARATUS AND METHOD FOR CANNING FOOD PRODUCTS

FIELD OF THE INVENTION

This invention relates to an apparatus and method that can be adapted to generate different cross-sectional sizes of cakes of compressed food to be inserted into varying sizes of containers to thereby achieve versatility for the canning apparatus.

BACKGROUND OF THE INVENTION

Canning apparatus have been developed for canning various cooked and uncooked food products such as fish, fowl, meat and vegetables. The food products are typically cut into chunks and deposited in a ring shaped basin or trough that rotates around a center axis. Dispensing sleeves depend from the ring-shaped basin. Containers are carried at a position radially outward from the rotating path of the dispensing sleeves. Receptacles that shuttle back and forth between the dispensing sleeves and containers (and thus are referred to as shuttles) receive a measured quantity of food from the sleeves and transfer and deposit that quantity into the containers. The filled containers are sequentially removed and replaced with unfilled containers and the shuttles move back and forth in a reciprocating manner to provide an endless process of filling the containers.

Such apparatus have heretofore been designed to accommodate containers of a single diameter. Such apparatus and improvements thereto are disclosed in the commonly assigned patents: U.S. Pat. No. 2,602,578, issued July 8, 1952; U.S. Pat No. 3,346,403, issued Oct. 10, 1967; U.S. Pat. No. 4,330,252, issued May 18, 1982; U S. Pat. No. 4,594,066, issued June 10, 1986. If a canning company desired to accommodate different sized containers, an apparatus for each size was required.

The apparatus is complex and expensive and thus canning companies have been limited in their ability to provide canning services as between customers desiring canning in different sized containers.

The concept of simply converting an apparatus to accommodate different sizes of containers is not obviously feasible. The handling of food products requires frequent and thorough cleaning of the areas where the food products contact the apparatus. Thus, replacement parts that require significant time and effort to disassemble and assemble are not acceptable. Attachments of any kind are a problem because the joints unavoidably create creases for the food to become embedded and as such produce cleaning problems.

SUMMARY OF THE INVENTION

The preferred embodiment of the present invention overcomes the heretofore restriction of one apparatus for one can size. In converting the apparatus to accommodate different can sizes, one needs to consider that the sleeve opening through which the food is dispensed from the dispensing trough must be matched to the container opening. Also, the compressing plunger which moves the food product through the sleeve and into the shuttle cavity must be matched to the sleeve opening. Also, the shuttle cavity must be matched to the container opening, and the container holder must accommodate the different diameter containers.

A key to the present invention for converting the apparatus is the provision of replaceable inserts for changing the size of the dispensing sleeve. Replaceable shuttles are designed to provide support for the sleeve and alleviate the need for sleeve attaching means. This arrangement permits very rapid removal and replacement of the sleeves. A quick release fastener is all that is required for retaining the insert in the sleeve. The food product is pushed down through the insert with a plunger which urges displacement of the insert. However, the insert is bottomed on the shuttle and the shuttle prevents such displacement. The return stroke of the plunger produces only a slight lifting action on the insert and the quick release fastener is adequate to prevent such lifting.

The shuttles slide back and forth in guide slots and the sliding is motivated by a cam mechanism that is not attached to the shuttles. Thus, the shuttles are simply lifted from the guide slots and replaced with the different sized shuttles.

The container holders or saddles are also readily replaced. They are simply arms that have curved nesting areas that accommodate the particular container size. The arms are rapidly disconnected and replaced in that they are held by spring loaded pins at a single connecting point.

These and other accommodating features have enabled the successful production of a convertible apparatus that has minimum down time for conversion to different container sizes and accordingly can be rapidly set up to accommodate different customer needs. Furthermore, the features accommodate ready removal and replacement for cleaning. A greater appreciation will be derived with reference to the detailed description that follows and the accompanying drawings.

DESCRIPTION OF THE PREFERRED EMBODIMENT

Figure 1:
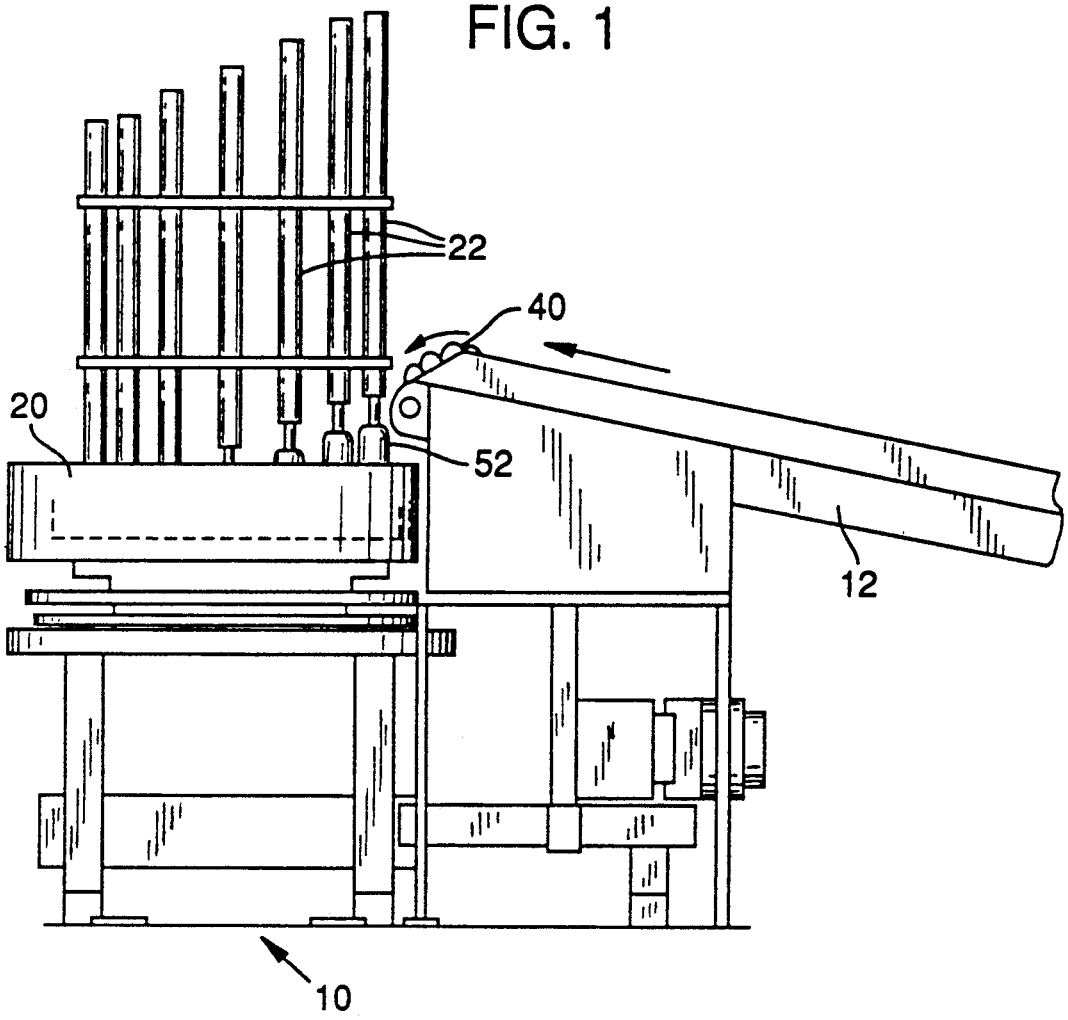
FIG. 1 is a schematic illustration of a machine of the present invention.
Figure 5:
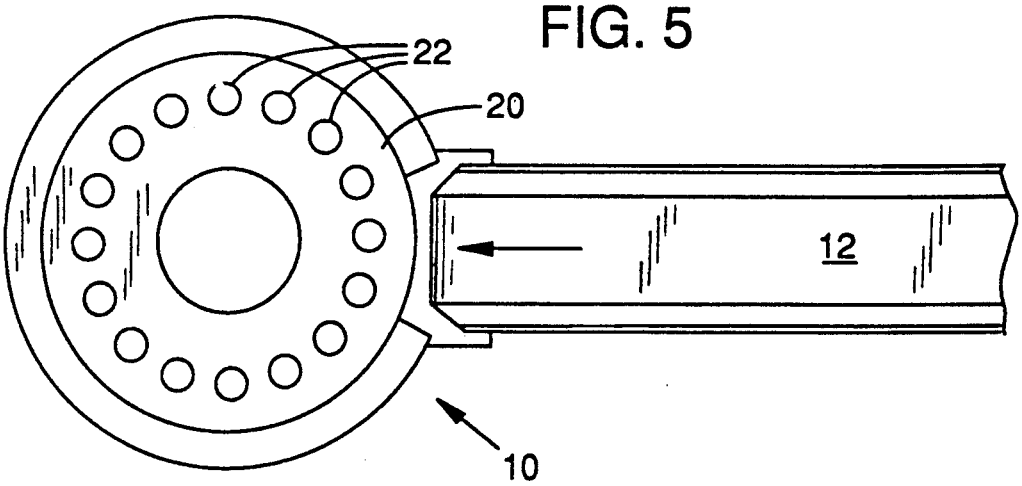
FIG. 5 is a top view of the machine illustrated in FIG. 1.

Refer now to FIG. 1 of the drawings. It illustrates a vertical axis turret type food product packing machine 10. The machine 10 is of the continuous rotary type having multiple food dispensing stations positioned circumferentially around the turret for dispensing and packing a food product into containers. Food product 40 that has been pre-sectioned is conveyed by a conveyor 12 and deposited into the rotating basin 20 of the machine 10. As the food product is rotated in the basin, it passes through a series of operations that are illustrated in FIG. 3.

The operating principle of the machine 10 is diagrammatically depicted in the four stages of operation as designated by the letters A, B, C and D of FIG. 3. Only one of the stations is shown at each of the selected positions. Only the essential operative components necessary for an understanding of the operation are shown.

As shown in the views, food product 40 is contained in basin 20. An upper plunger 22 is positioned for pressing a quantity of the food material through the sleeve or cylindrical bore 18. A lower plunger 24 forms the bottom wall of a shuttle pocket 28 supported on a shuttle plate 26. A tamper plunger 30 is positioned above an opening 23 in the shuttle plate 26. A container deck 32 supports a container 38 aligned with the opening 23 and with the tamper plunger 30.

View A depicts the first phase of the filling cycle. The product 40 to be filled in the container 38 is received in the basin 20 with the product deposited over and into the cylindrical bores 18 of the basin 20. As an aid in directing the product into the bores, an internal baffle 42 is provided in the basin.

View B shows the upper plunger 22 descending (by cam action) to force the product 40 through the cylindrical bore of the basin 20 into the bore of the shuttle pocket 28. The lower plunger 24 has been elevated to a position (also by cam action) to oppose the compressive action of the upper plunger. The upper plunger is yieldably biased in the downward direction by a compression spring to therefore control the compressive force. The compression of the product between the upper and lower plungers produces a uniform cylindrical "cake" in the bore of the basin and the shuttle pocket.

View C shows a stationary knife 34 severing a portion of the "cake" formed in the shuttle pocket from the remaining "cake" in the bore of the basin. As shown the "cake" is severed while still under compression to provide for uniformity.

View D shows the final stage where the cam 36 has moved the shuttle pocket 28 on the shuttle plate 26 to be in alignment with the outer bore of the shuttle plate and the tamper plunger 30. The container 38 to be filled is also aligned with the outer bore of the shuttle plate. As shown, the tamper plunger 30 has descended to transfer the product 40 from the shuttle pocket 28 into the container 38.

As shown in views A, B, C and D, the machine is dedicated to a container having a single diameter. To accommodate a container having a different diameter the following changes must be made; the upper and lower plunger head diameters, the cylindrical bore diameter of the basin, the bore of the shuttle pocket, the inner and outer bores of the shuttle plate, the tamper plunger diameter and the container saddles. Note that the container saddles were not shown in the views A, B, C and D for clarity. The saddles mount to the underside of the shuttle plate and guide the containers.

The following detailed description details the tooling and method of converting (or swinging) a machine from one diameter to another.

Figure 4:
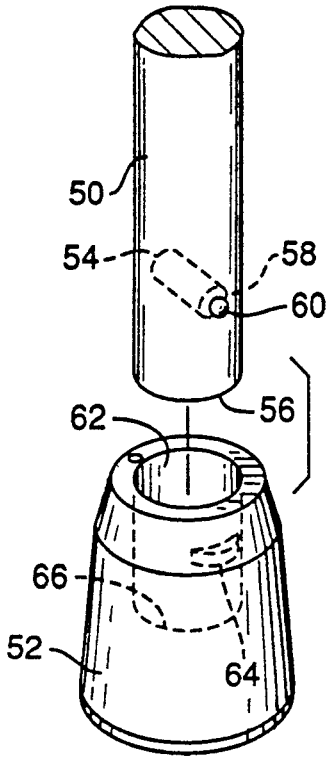
FIG. 4 is an exploded view of the upper plunger and shaft utilized in the machine.

Refer now to FIG. 4 of the drawings. It shows the upper plunger 22 having an upper plunger shaft 50 and a quick change plunger head 52. The plunger shaft 50 is a part of the upper plunger assembly and the quick change plunger head 52 is mountable on the shaft. The shaft 50 has a through cross bore 54 at a determined distance from an end 56. The bore 54 is threaded to accept a depressible spring plunger assembly 58 which is threaded on its exterior diameter. The plunger assembly 58 is threadably inserted into the threaded bore in a conventional manner with a cylindrical plunger 60 of the assembly extending beyond the external diameter of the shaft. The plunger 60 is biased by a spring so that the plunger extends out of the body of the assembly and is yieldably depressible into the body of the assembly so that the plunger does not extend beyond the surface of the shaft.

The quick change plunger head 52 as shown in the figure has a central blind bore 62 to accept the insertion of the shaft 50. A formed arcuate groove 64 transverse to the longitudinal axis of the bore 62 is provided in the wall of the blind bore and is of a depth to accept the insertion of the plunger 60. The groove 64 being arcuate, thus has its ends blended with the inner wall of the bore 62 which provides an inclined plane from the intersection of the inner wall with the ends of the groove 64 to the depth (base) of the groove. The groove 64 is at a dimension from the base 66 (bottom) of the bore 62 so that it will be aligned with the plunger 60 on the shaft when the end of the shaft abuts the base of the bore. The width of the groove 64 is greater than the diameter of the plunger 60.

The plunger head 52 is retained on the shaft 50 by the plunger 60 extending into and abutting the upper side wall of the formed groove 64. However, during compression, i.e. in the down stroke, the bottom 56 of the shaft bottoms on the base 66 of bore 62 before the plunger 60 abuts the lower side wall of groove 64. Thus a minimum of shear force is applied against plunger 60. To remove the plunger head 52 from the shaft 50, the plunger head is rotated relative to the shaft. The plunger 60 travels on the inclined plane depressing the plunger into the body of the plunger assembly 58. Once the plunger 60 exits the groove 64, the head 52 is merely slid off of the shaft 50.

Figure 2:
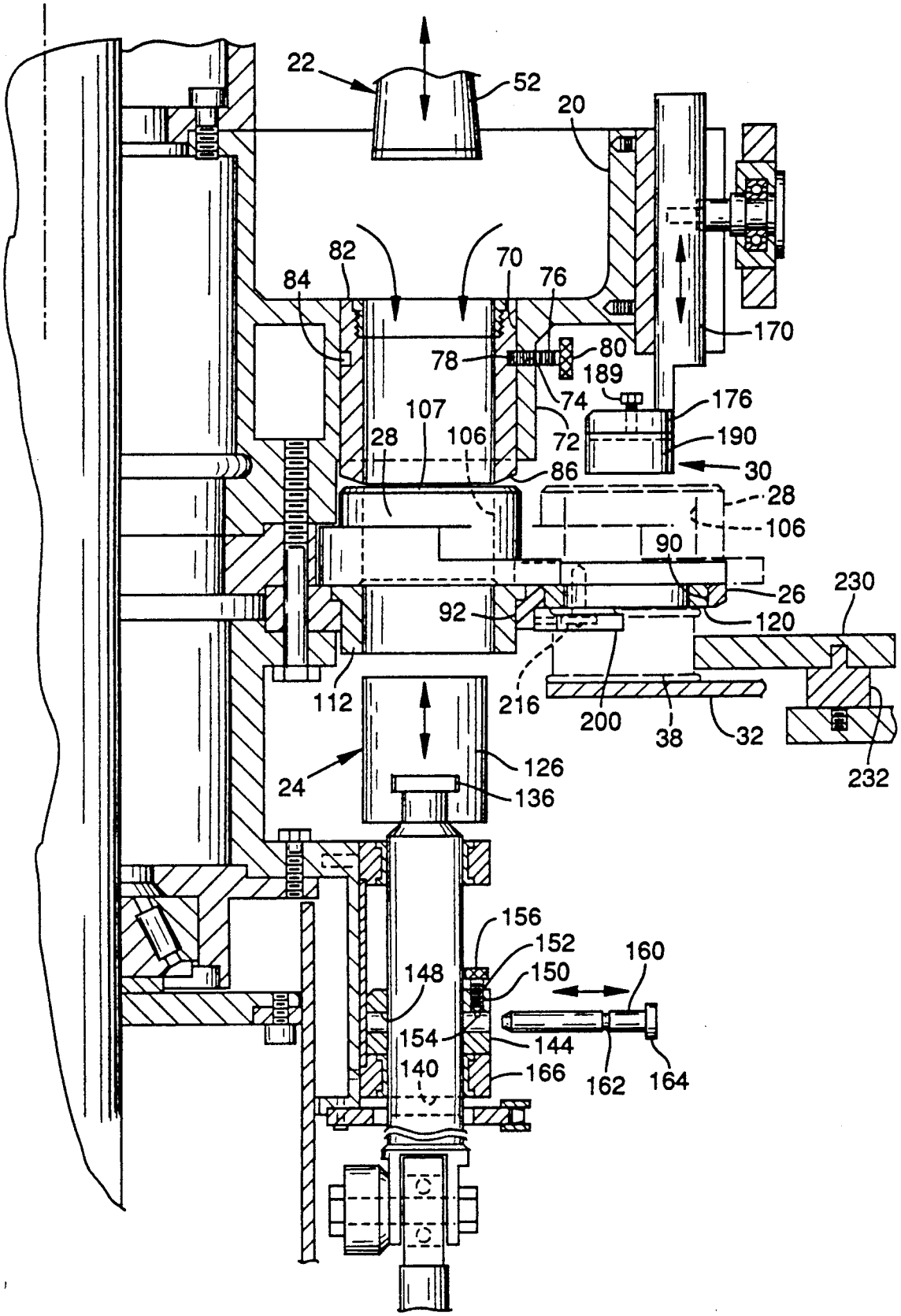
FIG. 2 is a section view of the machine of FIG. 1 illustrating the inter-relationship of the operating components.
Figure 3A:
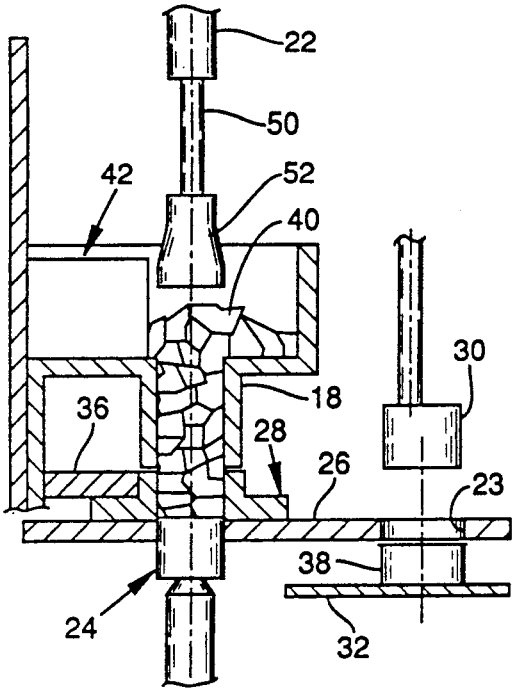
FIGS. 3*a*, 3*b*, 3*c* and 3*d* are a series of figures illustrating the stages of operation of the machine of FIG. 1.
Figure 3B:
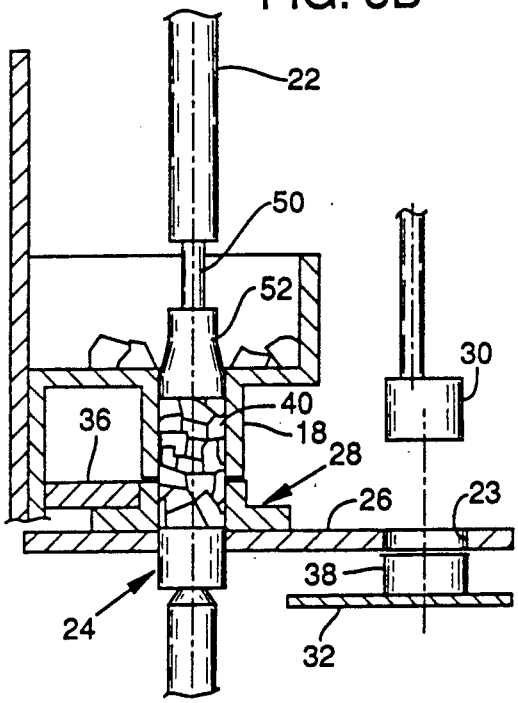
Figure 3C:
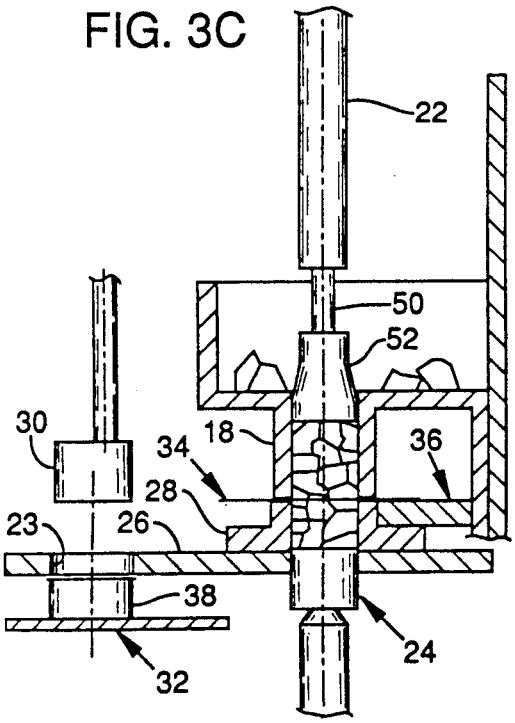
Figure 3D:
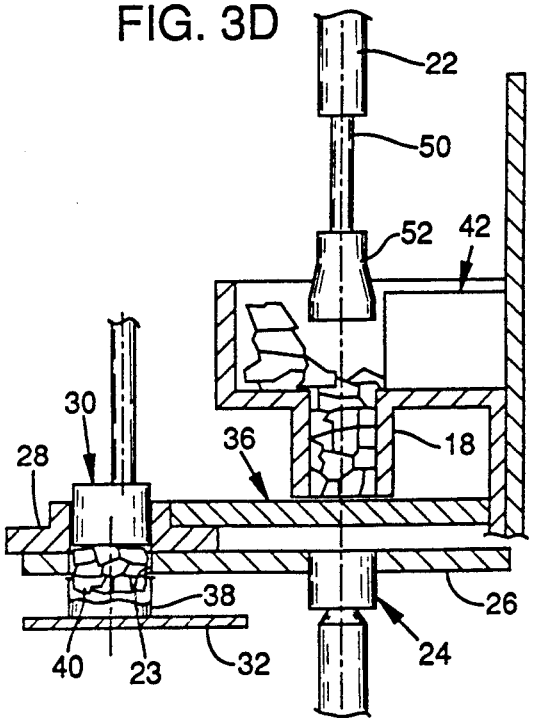

A portion of the receiving basin 20 showing the cylindrical bores 70 in its base is illustrated in FIG. 2. A depending wall 72 of the cylindrical bore has a through bore 74 that is internally threaded to accept a spring plunger assembly 76 which is threaded on its external diameter. The assembly is threadably inserted into the bore 74 of the basin, with the spring biased, slidable locking plunger 8 of the assembly extending into the bore. A knob 80 is provided for retracting the plunger into the assembly. The bore 70 of the basin is of a dimension to accept the insertion of the sleeve 82.

Figure 6:
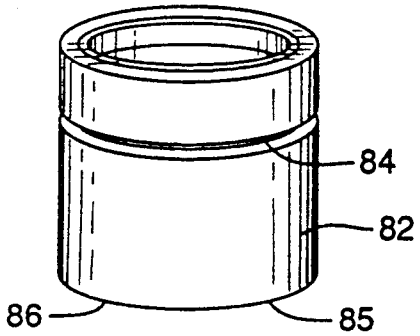
FIG. 6 is an insert for the basin of FIG. 2.

FIG. 6 shows the insertable sleeve 82 for the receiving basin cylindrical bore 70. The sleeve 82 is an open ended cylinder having an internal bore diameter of a size to produce a "cake" corresponding to the diameter of container to be filled. A peripheral groove 84 is provided on the external diameter of the sleeve. The groove 84 will receive the plunger 78 of the plunger assembly 76 installed in the side wall 72 of the cylindrical bore 70 of the basin. The width of the groove 84 is greater than the diameter of the plunger 78 which permits the sleeve 82 to have some motion along the longitudinal axis when installed in the basin bore 70. As shown in FIG. 2, the sleeve 82 is inserted into the bore 70 of the basin and is retained by the plunger 78 extending into the groove 84. The plunger assembly has a knob 80 for retracting the plunger 78 to facilitate installation of the sleeve in and removal of the sleeve from the bore 70 of the basin.

An end 85 of the sleeve 82 has a beveled section 86 (See FIG. 2). The beveled section 86 enables the stationary knife 34 to enter between the sleeve 82 and the top of the shuttle pocket 28 as will be explained later.

Figure 7:
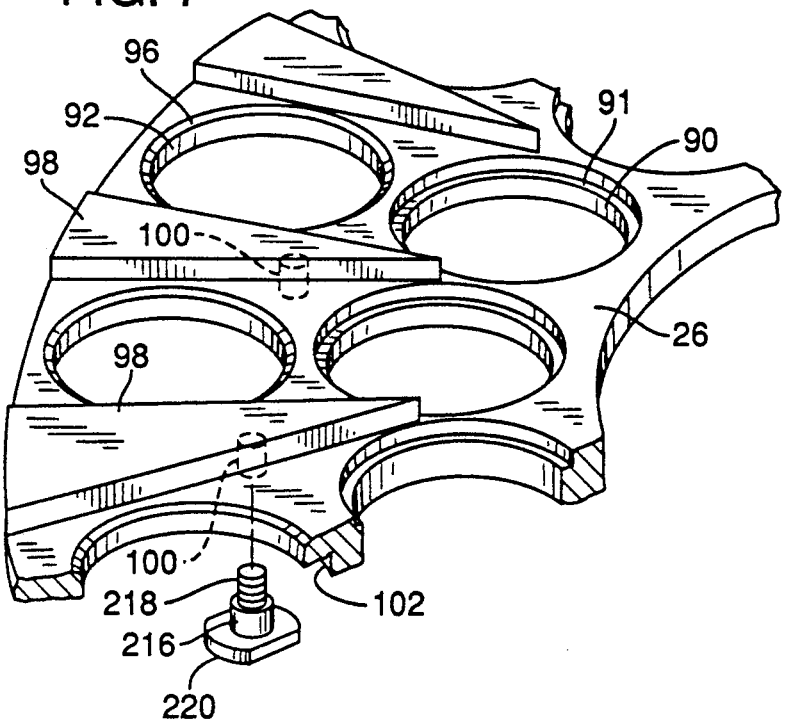
FIG. 7 is a view of a shuttle plate.

FIG. 7 illustrates a portion of the shuttle plate 26 and it shows the internal bore 90 that is aligned with the cylindrical bore 70 of the basin and the outer bore 92 which is aligned with the tamper head. The inner bore 90 and the outer bore 92 of the shuttle plate are radially aligned. The inner bore 90 of the shuttle plate is a stepped through bore, the step 91 forming a recess to accept a shoulder of the inner bore insert 112. The outer bore 92 of the shuttle plate is a through bore that has a chamfered upper edge 96 for receiving the beveled edge of the outer bore insert 120. Guide bars 98 are mounted on the shuttle plate 26 to radially guide the shuttle pocket 28 as it is moved from alignment with the inner bore 90 to alignment with the outer bore 92.

An internally threaded bore 100, positioned between adjacent bores 92 and at a distance from a shoulder 102, is provided in the shuttle plate 26 for installing a saddle stud 216.

Figure 8:
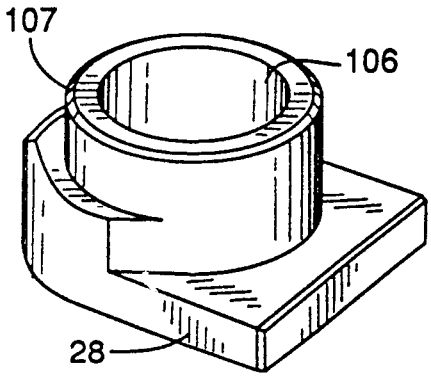
FIG. 8 is a view of a shuttle pocket supported on the shuttle plate.

FIG. 8 illustrates the configured shuttle pocket 28 (also referred to as a shuttle). The shuttle pocket 28 has a through bore 106 corresponding to the internal bore diameter of the sleeve 82. An upper edge 107 of the shuttle pocket is beveled as shown in the figure; the edge 107 to cooperate with the beveled section 86 of the sleeve 82 to permit entry of the stationary knife 34 between the sleeve 82 and the pocket 28. The shuttle pocket 28 is moveable radially on the upper surface of the shuttle plate 26.

Figure 9:
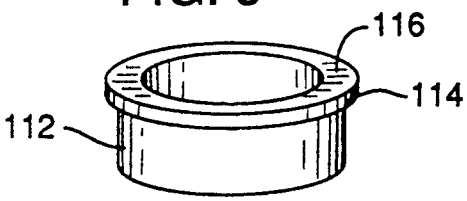
FIGS. 9 and 10 are views of inserts for the shuttle plate openings.

FIG. 9 illustrates the cylindrical inner shuttle plate insert 112. The insert 112 is installed in the inner bore 90 of the shuttle plate 26. The inner bore 90 of the shuttle plate is stepped to receive a radially extending shoulder 114 on the upper portion (as viewed in the figure) of the insert 112. The insert has an internal diameter corresponding to the bore 106 of the shuttle pocket. The upper edge 116 of the insert 112, when installed, is flush with the upper surface of the shuttle plate 26.

Figure 10:
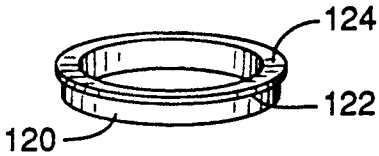

FIG. 10 illustrates the cylindrical outer shuttle plate insert 120. The insert 120 is a shaped open ended cylinder having an internal diameter corresponding to the bore 106 of the shuttle pocket 28. As shown in the figure, the upper portion of the insert 120 has a beveled shoulder 122 extending radially from the upper portion of the insert. The bevelled shoulder 122 fits in a mating chamfered edge 96 of the outer shuttle plate bore 92. The upper edge 124 of the insert, when installed, is flush with the upper surface of the shuttle plate 26.

Figure 11:
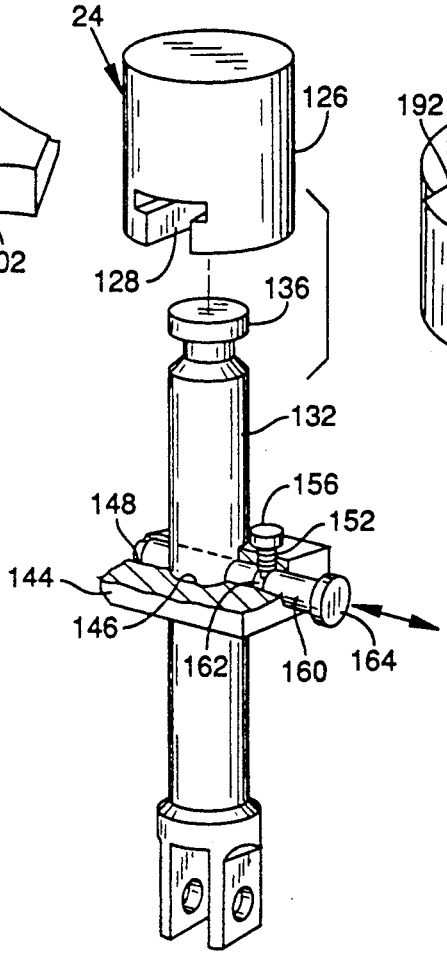
FIG. 11 is a view of a lower plunger head, plunger tube and support mechanism therefore.

FIG. 11 illustrates the lower plunger head 126 and lower plunger tube 132. The head is cylindrical in shape having a diameter relative to the internal diameter of the inner shuttle plate insert 112 and the internal bore diameter of the shuttle pocket 28. As shown in the figure, the plunger head 126 has a "T" slot 128 formed at one end transverse to its longitudinal axis that will accept the formed stud 136 on the end of the lower plunger tube 132.

FIG. 11 illustrates the lower plunger tube 132 and anti-rotation block 144. The lower plunger tube has affixed to an end 134 (as by welding) a formed stud 136 that will fit slidably in the "T" slot 128 formed in the lower plunger head 126.

A through cross bore 140 is provided that extends through the side walls of the tube 132; the axis of the bore 140 intersecting the longitudinal axis of the tube 132 at a right angle.

The anti-rotation block 144 has a through bore 146 of a diameter to accept the slidable insertion of the lower plunger tube 132. Another through bore 148 is provided in the block which is at a right angle to and intersects the through bore 146. The bore 148 is of the same diameter as the cross bore 140 in the lower plunger tube 132. A bore 150 which is internally threaded is provided in the block that intersects the through bore 148. A spring biased plunger assembly 152 is threadably installed in the threaded bore 150, with a plunger 154 extending into the bore 148. The plunger 154 is retractable into the assembly 152 by a knob 156.

A retention pin 160 as shown, fits slidably in the cross bore 140 of the tube and the bore 148 of the block 144. The pin 160 has a formed peripheral groove 162 into which the plunger 154 of the plunger assembly 152 will enter to retain the pin 160 in position. A shaped head 164 is provided on the pin for ease of insertion and removal. The cross bore 140 of the tube and the cross bore 148 of the block are aligned, the plunger 150 is retracted and the pin 160 is inserted in the bores and the plunger 150 enters the groove 162 to retain the pin in position. The pin 160 thus affixes the tube to the block 144. As shown in FIG. 2, the anti-rotation block 144 not only prevents rotation of the lower plunger tube, it also provides a lower travel limit by contacting a lower stop 166.

Figure 12:
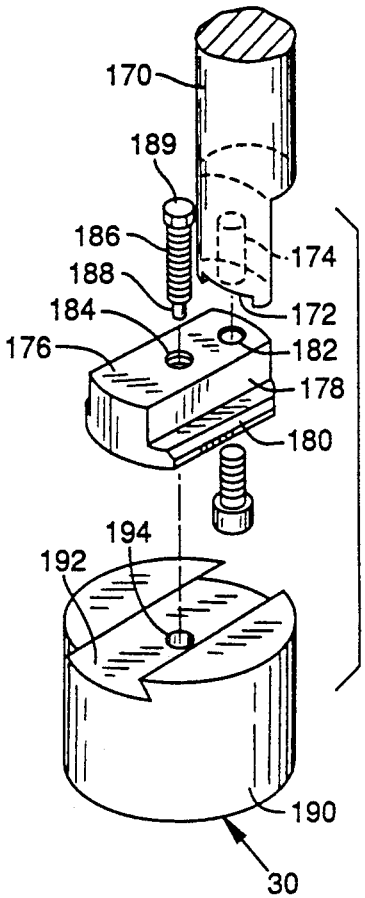
FIG. 12 is a view of the tamper plunger head and shaft.

A tamper (transfer) plunger shaft 170 and mounting shoe 176 are illustrated in FIG. 12. As shown in the figure the end of the shaft 170 is configured for attaching the mounting shoe, having a formed rectangular recess 172 and a bore 174 that is internally threaded. The mounting shoe 176 as shown in the figure has an upper rectangular section 178 that fits in the formed recess 172 of the shaft 170. The lower portion of the shoe has a male dovetail 180 formed in a conventional manner. As shown, the width of the dovetail 180 is wider than the rectangular section 178. A counterbored through hole 182 near one end of the shoe facilitates mounting of the shoe to the shaft by a fastener in a conventional manner. An internally threaded through bore 184, parallel to the mounting hole, is provided for installing a spring plunger assembly 186, with the plunger 188 of the assembly extending below the bottom surface (as viewed in the figure) of the dovetail 180. The plunger 188 is retractable by a knob 189.

A tamper plunger head 190, cylindrical in shape is as shown in FIG. 12. The tamper plunger head 190 has a female dovetail 192 that mates with the dovetail 180 of the shoe 176. The female dovetail 192 is transverse to the longitudinal axis of head 190. A blind bore 194, having its axis co-incident with longitudinal axis of the head 190, is provided in the dovetail section of the head and is of a diameter to accept the plunger 188 of the plunger assembly installed in the shoe 176.

Figure 13:
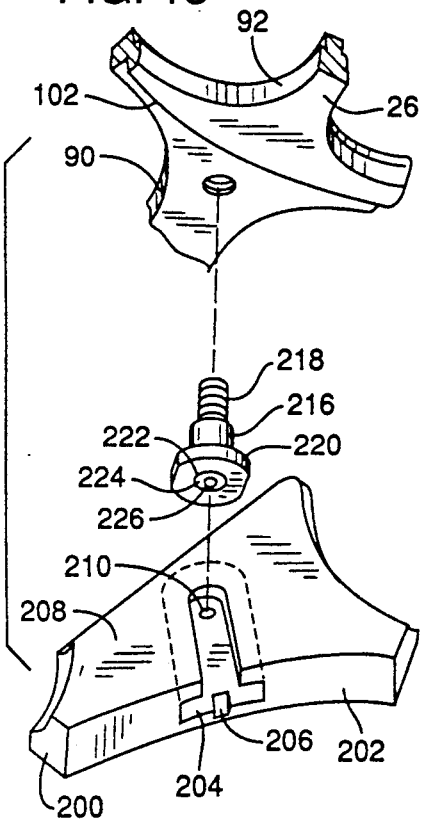
FIG. 13 is a view of the container saddle used in connection with the machine of FIGS. 1 and 2.

FIG. 13 illustrates the container saddle 200 and saddle stud 216. The saddle 200 has a peripheral profile for guiding the containers. The saddle 200 has an arcuate section 202 that mates with the shoulder 102 of the shuttle plate 26 (See FIG. 7). A "T" slot 204 is provided that is radially aligned relative to the center point of the arcuate section 202 and extending from the edge of the arcuate section into the body of the saddle where it terminates. As shown the base of the "T" slot 204 is parallel to the upper surface 208 of the saddle 200. A plunger ramp 206 is provided in the base of the "T" slot 204, the ramp 206 being a slot commencing at the edge of the arcuate surface 202 at a depth sufficient to accept the plunger 226 extending out of the saddle mounting stud 216 and intersecting the base of the "T" slot at a distance from the edge of the arcuate section. The ramp 206 thus provides an inclined plane relative to the base of the "T" slot 204 and will depress the plunger into the stud 216 permitting the stud to enter the "T" slot of the saddle 200.

A through bore 210 is provided in the "T" slot 204, the bore at a distance from the radiused end to accept the plunger 226 of the stud 216 when the saddle is installed on the stud.

The saddle stud 216 is as shown in the figure, having a threaded end 218 and a shaped head 220 on the opposite end. The stud 216 is installed in the threaded bore 100 provided in the shuttle plate 26. The head 220 is configured to fit in the "T" slot 204 of the container saddle 200. A threaded blind bore 222 is provided in the end of the head 220. An externally threaded spring plunger assembly 224 is installed in the bore 222 with a plunger 226 of the assembly 224 extending beyond the surface of the head 220.

Changeover Procedure

It is considered important that the machine 10 of this invention is convertible to different container sizes with minimum requirement of any mechanic's tools.

The plunger head 52 is installed on the upper shaft 50 by manually depressing the plunger 60 permitting the shaft 52 to enter the bore 62. As the end 56 of the shaft 50 abuts the base 66 of the bore 52, the plunger 60 enters the arcuate groove 64 to thereby retain the plunger head 52 on the shaft 50.

The sleeve 82 is inserted in the bore 70 of the basin 20 until the sleeve 82 contacts the plunger 78. The plunger 78 is retracted by moving the knob 80 permitting the sleeve to be lowered further into the bore 70. The knob 80 may then be released, which will cause the plunger to come into contact with the exterior wall of the sleeve 82. The sleeve is lowered until the plunger 78 enters the groove 84 formed in the exterior of the sleeve 82. The plunger 78 entering the groove 84 retains the sleeve 82 in position.

The inner insert 112 is installed in the inner bore 90 of the shuttle plate 26 with the shoulder 114 of the insert fitting in the recess formed by step 91 of the bore 90.

The outer insert 120 is installed in the outer bore 92 of the shuttle plate 26 with the bevel 122 of the insert fitting in the chamfered edge 96 of the outer bore 92.

To install the lower plunger head 126 on the stud 136 of the lower plunger tube 132, the plunger tube assembly must be lowered. The station to be tooled is advanced until the tube assembly is beyond the lower cam that moves the tube assembly upward. As is known, the lower cam is provided only on that portion of the cycle requiring the lower tube assembly to be elevated. Lowering the tube assembly is accomplished by removing the pin 160 from the tube 132 and stop block 144. The plunger 151 is retracted, out of the groove 162 in the pin 160 by moving the knob 156. The pin 160 is retracted out of the tube 132 and the stop block 144, permitting the tube to slide downwardly in the bore 146 of the block 144. The lower plunger head 126 is slid on the stud 136, with the stud fitting in the "T" slot 128 of the head 126. The head is centrally positioned on the stud so that the head is aligned with the insert 112 installed in the inner bore 90. The tube assembly with the head installed is elevated and the pin 160 is re-inserted into the tube and block with the plunger 154 entering the groove 162 to retain the pin in position.

The tamper plunger head 190 is mounted on the shoe 176 by retracting the plunger 188 by the knob 189 and fitting the dovetail of the head 190 to the dovetail 180 of the shoe 176. The head is slid onto the shoe until the plunger 188 enters the blind bore 194 in the head 190.

The container saddle 200 is mounted to the under side of the shuttle plate 26 with the "T" slot 204 fitting on the head 220 of the stud 216. As the stud 216 enters the "T" slot 204, the plunger 226 of the plunger assembly 224 installed in the head 220 engages the ramp 206. Further movement of the saddle onto the stud depresses the plunger 226 into the assembly 224 permitting the saddle to slide fully onto the stud. The arcuate section 202 will abut the shoulder 102 of the shuttle plate 26 and the plunger 226 will enter the bore 194 to retain the saddle 200 in position. As shown in FIG. 2, the retainer 230, held on the machine frame by pin 232, retains the containers against centrifugal urging during operation. It is replaced to provide the correct radius for the selected container size. The guide bars that guide the containers to and from the machine are also changed to accommodate the selected container size.

The shuttle pocket 28 is installed on the shuttle plate 26 between adjacent guide bars 98 in alignment with the sleeve 82 fitted in the bore 70 of the basin 20.

The machine 10 equipped with the tooling described above has the same operating principle as previously described in reference to FIG. 3.

As previously mentioned the sleeve 82 has some longitudinal movement as permitted by the groove 84 having a greater width than the plunger 78. During the compression cycle, the sleeve 82 will abut the top of the shuttle pocket, therefore limiting its travel. In this way the plunger 78 does not have to resist the forces imparted during the compression cycle.

As the machine rotates in its cycle and the station encounters the stationary knife as depicted in view C of FIG. 3, the beveled edges on the lower edge of the sleeve 82 and the upper edge of the shuttle pocket 28 permit entry of the knife between the sleeve and the shuttle pocket. The beveled edges have the further benefit of preventing the knife edge from cutting into the sleeve and shuttle pocket. The sharpened edge of the knife entering the area of the beveled edges will then separate the sleeve 82 from the shuttle pocket 28 by elevating the sleeve.

The inner insert 112 and the outer insert 120 fitted in the inner and outer bores of the shuttle plate are retained in position by the shuttle pocket 28. The shuttle pocket 28 is of sufficient length to be in contact with the inserts regardless of its position on the shuttle plate 26. When the shuttle pocket is aligned with the inner insert, the trailing edge "covers" a portion of the outer insert to retain it in position. Similarly, when the shuttle pocket is aligned with the outer bore the leading edge of the shuttle pocket "covers" a portion of the inner insert to retain it in position.

The tooling set is easily removed for cleaning or in preparation for another set to accommodate a container of a different diameter.

The shuttle pocket 28 is merely lifted off the shuttle plate 26.

The tamper plunger head 190 is removed by retracting the plunger 188 by knob 189. The head 190 is then slid off the shoe 176.

The lower plunger head 126 is removed from the tube in the same manner as it was installed, that is the tube assembly is lowered and the head 126 is slid off of the stud 136.

The inner insert 112 is lifted out of the bore 90 and the outer insert 120 is lifted out of the outer bore 92.

The sleeve 82 is removed from the bore 70 by retracting the plunger 78 by knob 80 and lifting the sleeve out of the bore.

The upper plunger head 52 is removed from the shaft 50 by rotating the plunger head 52 relative to the shaft 50. Rotation of the head 52 relative to the shaft 50 causes the plunger 60 to travel on the incline of the groove 64 to thus depress the plunger into the assembly 58 and exit the groove 64. Once the plunger is out of the groove, the head may be slid off the shaft.

The only item requiring a tool to remove is the container saddle 200. A rod having a diameter of the plunger 226 is inserted into the bore 210 to depress the plunger 226 into the plunger assembly 224. The saddle 200 may then be slid off the stud 216.

Whereas the above-described embodiment has the benefit of matching the apparatus to different container sizes, a further application for the basic concept has been developed. There are many canned food products that are a mixture of food ingredients. For example, canned chile will include quantities of beans and meat. Canned soups will include quantities of liquid, vegetables, meat, etc. Presently these materials are pre-mixed and then placed as a mixture in the containers. However, a homogenous mixture of the ingredients is not readily achieved and the containers may well carry different mixes of the canned product.

The variation developed for the present invention is to provide a consistent balance of the ingredients. Thus, the basin sleeve, plungers and shuttles will be matched to a desired quantity of food product to be placed in the container rather than to the container size. For example, hamburger can be placed in the basin and the sleeve, plungers and shuttles sized to insert four ounces of hamburger into a twelve ounce container for chile.

Other variations will become apparent to those skilled in the art without departing from the invention, the scope of which is determined from the appended claims.

I claim:

1. In a food canning apparatus for automatically inserting a pre-determined mass of a solid food product into a pre-determined size of container, said apparatus comprising;

a basin for receiving food products to be canned, spaced open ended sleeves depending from the basin and means for ejecting food from the basin through the sleeves, a container holder having container holder positions located outwardly of said sleeves for holding open top containers of a determined size, food conveying shuttles, and shuttle moving means for moving the shuttles between a first position below the open bottom sleeves and a second position above the open top containers positioned in said container holder positions, said shuttles having a through opening defining top and bottom openings wherein the top opening is aligned with the open sleeve bottom in said first position and the bottom opening is aligned with the open top container in said second position, support means located below the shuttles when in the position aligned with the sleeves, said support means closing the bottom opening of the shuttles, said ejecting means including a food compressing plunger insertable into the sleeves for compressing a pre-determined quantity and mass of the food product into the shuttles when in the first position, said filled shuttles moved by the shuttle moving means into the second position over the container, and a transfer plunger positioned over the shuttle when in the second position for forcing the pre-determined quantity and mass of food product contained in the shuttles into the containers, and the improvement that comprises;

said sleeve openings and shuttle openings having a similar size, and means for changing the sleeve openings size and means for changing the shuttle openings size to maintain said relative similar size while selectively varying the quantity and mass of the food product inserted into the shuttles and thereby conveyed to and inserted into the containers.

2. An apparatus as defined in claim 1 wherein the means for changing the sleeve openings size comprises replaceable sleeve inserts having an outside configuration that fits the sleeve, and different wall thicknesses to vary the opening therethrough.

3. An apparatus as defined in claim 2 wherein said insert has an indentation, and a locking plunger protrudes through the sleeve and into the indentation.

4. An apparatus as defined in claim 3 wherein the indentation is vertically slotted and permits limited vertical movement of the insert relative to the sleeve, said insert depending below the sleeve bottom and into abutment with said shuttle, a slicing blade mounted to slide between the sleeve and shuttle with the shuttle in said first position, and in the process to engage and raise the insert as permitted by the limited vertical movement provided thereto.

5. An apparatus as defined in claim 4 wherein the support means comprises a shuttle plate having an opening therethrough that is of a size similar to the shuttle opening and sleeve opening and in alignment with the sleeve opening, a depth determining plunger that is sized to fit the opening of the shuttle plate and movably projects through the shuttle plate opening and into the shuttle openings at a controlled depth therein, and control means controlling the plunger for placement of the plunger prior to compression of the food product in the shuttle whereby the vertical height as well as the cross section of the compressed food product in the shuttle is controlled.

6. An apparatus as defined in claim 5 wherein interchangeable inserts define the openings size through the shuttle plate, said inserts being replaceable for conforming the size of the shuttle plate openings to the size of the sleeve openings.

7. An apparatus as defined in claim 6 wherein the compressing plunger and depth determining plunger are both comprised of plunger heads mounted on reciprocating shafts, quick release mounting means for removably mounting said heads to said shaft for conforming the size of the plunger heads to the size of the sleeve and shuttle plate openings.

8. An apparatus as defined in claim 7 wherein the shuttles are removable and replaceable to conform the size of the openings therethrough to the size of the sleeve openings, and removable and replaceable container holders to vary the size of the container in which the food products of the shuttle is deposited, and wherein said transfer plunger is comprised of a plunger head mounted on a reciprocating shaft and quick release mounting means for removably mounting said head to said shaft for conforming the size of the plunger head to the size of the container.

9. A method for automatically inserting a predetermined quantity and mass of solid food products into a predetermined size container comprising;

placing quantities of the food products into a basin and directing the food products into sleeve defining openings depending from the basin, and compressing the food product from the sleeve into a cavity of a moveable shuttle, said cavity having a depth and cross section conforming to the desired pre-determined quantity and mass of desired food products with the food products compressed therein, moving the shuttle to a container holder holding station and depositing the food product therefrom into a container in the holding station, and varying the amount of food product to be deposited in the container including the step of;

providing replaceable inserts for the sleeves to vary the cross-sectional size of the sleeve openings, providing replaceable shuttles having different cross-sectional size cavities and cooperatively changing the sleeve inserts and shuttles to accommodate a different quantity and mass of food products.

10. A method as defined in claim 9 including;

providing varying sleeve inserts and shuttles having varying cavities to match the desired container cross-sections, and changing the sleeve inserts and shuttles to provide a match-up to a selected container's cross-section.

11. A method as defined in claim 9 including;

determining a portion of food product from the basin to be inserted into the container, determining a shuttle cavity configuration including depth and cross-section for holding said determined portion, changing the sleeve inserts to provide a sleeve insert with the selected shuttle cross-section, and changing the shuttle to provide a shuttle with the desired cavity configuration.

* * * * *